United States Patent [19]

Schreder et al.

[11] Patent Number: 4,808,797

[45] Date of Patent: Feb. 28, 1989

[54] ELECTRIC HOTPLATE

[75] Inventors: Felix Schreder, Oberderingen; Josef Krist, Eppingen, both of Fed. Rep. of Germany

[73] Assignee: E.G.O. Elektro-Geräte Blanc u. Fischer, Fed. Rep. of Germany

[21] Appl. No.: 79,576

[22] Filed: Jul. 29, 1987

[30] Foreign Application Priority Data

Aug. 30, 1986 [DE] Fed. Rep. of Germany ..... 3629549

[51] Int. Cl.[4] ..... H05B 3/70

[52] U.S. Cl. ..... 219/458; 219/463

[58] Field of Search ..... 219/457, 458, 459, 463, 219/464, 467

[56] References Cited

U.S. PATENT DOCUMENTS

| | | | |
|---|---|---|---|
| 2,101,110 | 12/1937 | Thornton | 219/457 |
| 3,300,621 | 1/1967 | Fischer | 219/457 |
| 4,122,330 | 10/1978 | Fischer et al. | 219/449 |
| 4,650,969 | 3/1987 | Kicherer et al. | 219/451 |
| 4,658,118 | 4/1987 | Kicherer et al. | 219/451 |

FOREIGN PATENT DOCUMENTS

| | | | |
|---|---|---|---|
| 1021967 | 1/1958 | Fed. Rep. of Germany . | |
| 1291032 | 3/1969 | Fed. Rep. of Germany . | |
| 1565049 | 2/1970 | Fed. Rep. of Germany | 219/457 |
| 1690557 | 11/1973 | Fed. Rep. of Germany . | |
| 262004 | 9/1978 | Fed. Rep. of Germany . | |
| 3301219 | 7/1984 | Fed. Rep. of Germany . | |
| 3425896 | 1/1986 | Fed. Rep. of Germany . | |
| 994833 | 11/1951 | France | 219/457 |

*Primary Examiner*—Teresa J. Walberg

*Attorney, Agent, or Firm*—Steele, Gould & Fried

[57] ABSTRACT

A hotplate (11) has a flat, plate-like bushing (22) for connecting leads (19). The bushing (22) is directly fitted in a cover plate (20) of the hotplate (11) by means of retaining clips (34). The connecting leads (19) are threaded through the bushing, which bushing is retained in the cover plate (20). The cover plate (20), with bushing affixed is then fixed to the hotplate body. The bushing (22) is not supported on the hotplate underside (40), but is wholly supported in the cover plate (20), facilitating assembly by automated equipment.

14 Claims, 2 Drawing Sheets

ELECTRIC HOTPLATE

BACKGROUND OF THE INVENTION

1. Field of the Invention

The invention relates to an electric hotplate and more particularly to a bushing or passage member therefor and to a method for fitting the same.

2. Prior Art

Bushings are conventionally used with standard electric hotplates with the hotplate body made from a cast material and are described e.g. in applicant's U.S. patent application Ser. No. 930,491 filed Nov. 12, 1986. These bushings have an all-round shoulder, by which they are pressed by the cover plate against the underside of the embedding material enclosing the heating means. They are consequently in thermal contact with the heating means and heat up relatively rapidly.

In addition, bushings are known, which are only held by the wires passing through them and are not directly supported on the embedding material. However, in order to ensure a reliable hold, they require another base located outside the cover plate (British Pat. No. 1 577 367).

Fitting must take place in such a way that the bushings are threaded manually onto the leads and must be moved into position before the cover plate is placed over the bushing and then fixed. However, such fitting is complicated and cannot be automated.

An object of the invention is to provide an electric hotplate with a bushing which, in the case of comparable electrical and mechanical safety and strength, permits an easier and optionally automatic fitting. This object is achieved according to the invention as disclosed and claimed.

The bushing can now be fixed initially to the cover plate which can then, together with the bushing, be engaged on the ends of the leads, which are normally made from solid wire. Preferably the bushing is a relatively flat, plate-like member, which is fitted to the cover by means of bent down retaining clips and has a significant spacing from the underside of the heating means. As a result the bushing has a relatively low thermal mass.

It has hitherto been assumed that the connecting piece should always have a direct thermal contact with the underside of the heating means, so as to permit rapid heating and avoid condensation of moisture on the bushing during the heating up phase and so that there is no inadmissible reduction in electrical safety (leakage currents). It has been found that this does not occur in the case of the invention, which is clearly due to the flat shape with a relatively large surface facing the heating means as compared with the thermal mass.

According to a preferred method, automatic fitting is possible, in that the leads, following the fixing of the bushing to the cover plate, are automatically gripped and aligned by a gripper, so that the bushing, together with the cover plate can be threaded over the same.

Further advantages and features of the invention are explained in the claims and the following description in conjunction with the drawings, individual features leading to advantageous constructions, both individually or in combination.

BRIEF DESCRIPTION OF THE DRAWINGS

An embodiment is explained in greater detail hereinafter relative to the drawings, wherein show.

DETAILED DESCRIPTION OF THE PREFERRED EMBODIMENTS

Figure 1:
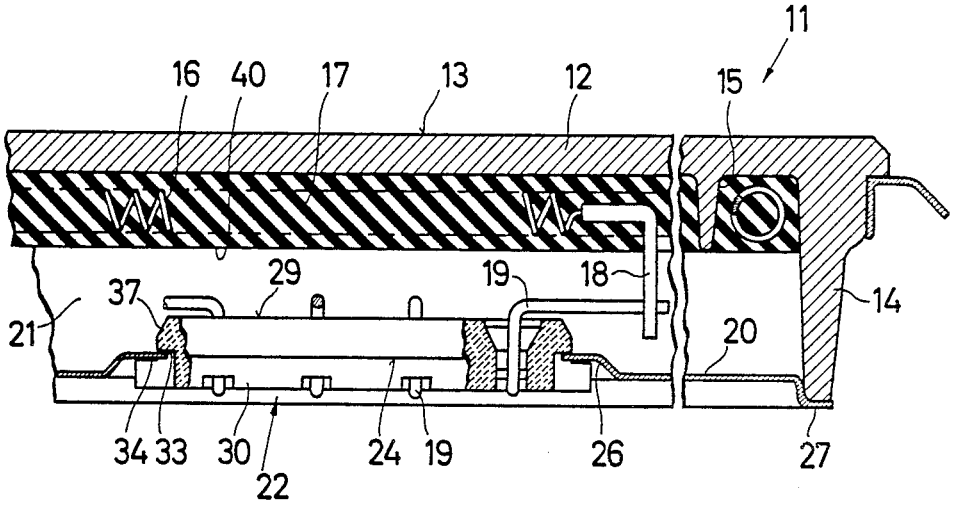
FIG. 1 is a vertical partial section along line I in FIG. 2.
Figure 2:
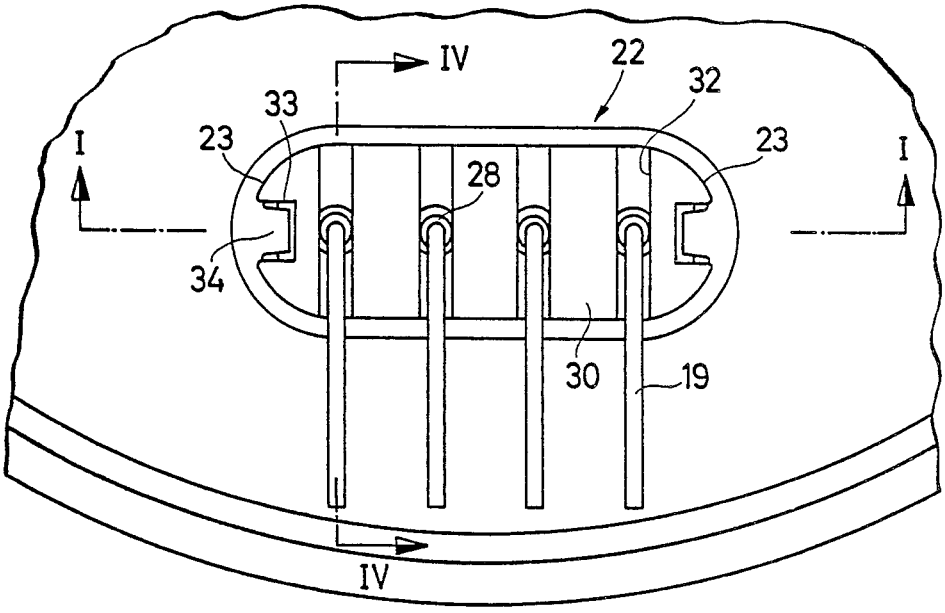
FIG. 2 is a view from below of part of a hotplate with bushing.
Figure 3:
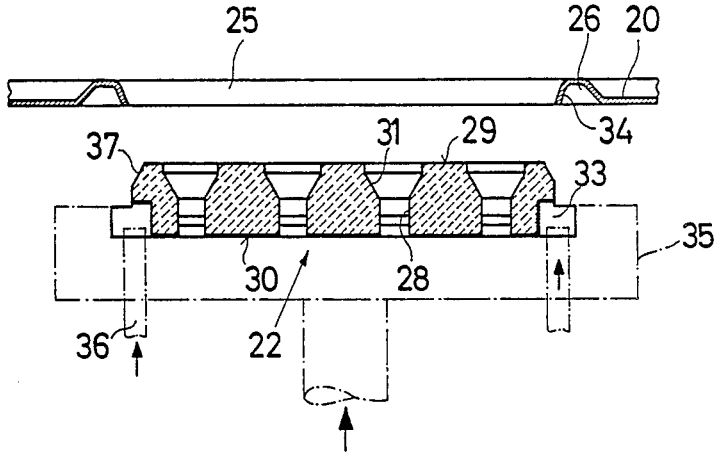
FIG. 3 is a section through the bushing and part of the cover plate prior to fitting to one another.

FIG. 1 shows part of an electric hotplate 11, which comprises a cast iron hotplate body 12 with an upper, closed, planar cooking surface 13 and an all-round, downwardly directed, flange-like rim 14. Heating resistors 16 comprising wire coils in spirally arranged grooves 15 on the underside of the hotplate body 12 are disposed in an originally pourable, compressed, electrically insulating embedding material 17. They are connected by means of terminal pins 18 projecting from the embedding material to leads 19, which comprise solid wires.

The underside of the hotplate is terminated by a shaped sheet metal cover plate 20, which is supported on rim 14 and terminates an inner zone 21 located outside the heating means and which is normally circular.

Figure 4:
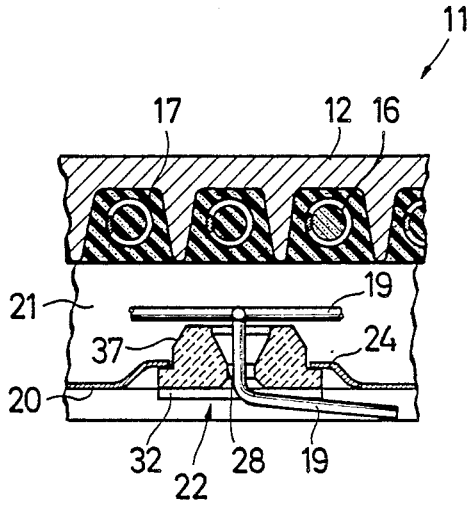
FIG. 4 is a section along line IV of FIG. 2.

To cover plate 20 is fixed a bushing or passage member 22, which is made from highly heat resistant insulating material, e.g. steatite. Bushing 22 is shaped like an elongated, plate-like body with rounded narrow sides 23. Through an all-round shoulder 24 (FIG. 4) of cover plate 20, bushing 22 is supported in the vicinity of an opening 25 of the cover plate, which at this point has an impressed depression 26 towards the hotplate body 12. As can be seen from FIG. 1, the bushing 22 does not project downwards beyond the lower edge 27 of the rim or cover plate 20 resting on it and also the leads passed through bushing 22 are still located below said lower edge, which is very important for packing for transportation purposes.

Bushing 22 has several and in the present case four passage openings 28 in the form of round or oval holes located in a row and which run from the inner flat side 29 to the outer flat side 30 and have on their inner sides, i.e. those facing the hotplate body 12 funnel-shaped insertion slopes 31. In the vicinity of the outside 30, groove-like depressions 32 are provided at right angles to the longitudinal extension of the bushing 22 and, as shown, in said depressions are located and guided the leads 19 bent towards the circumference on the underside of the hotplate. This also reduces the overall height. On the two narrow sides 23, bushing 22 has rectangular recesses 33, which extend from the lower flat side 30 to roughly the height of shoulder 24 and engage so far into the bushing that there is engagement behind the recessed, inner part of said bushing. Cover plate retaining clips 34 are bent into these recesses 33 and thus fix the bushing directly to the cover plate, i.e. without any need for indirect holding means for securing to leads, hotplate body or the like.

The connecting leads 19 (in this case four), are welded to the terminal pins 18 and project through the passage openings 28 and are then bent towards the outer rim of the hotplate.

On fitting the hotplate, initially the bushing 22 is fixed to cover plate 20. Two retaining clips 34 are constructed on the rim of opening 25, but are initially directed outwards (downwards), so that the recessed part of bushing 22 can be passed freely through the opening above the shoulder. This can take place automatically by corresponding gripping means. On the gripping means 35, indicated by dot-dash lines, carrying the bushing 22 can be provided members 36 which, after inserting bushing 22 into opening 25, are forced upwards and thereby engage round the retaining clips 34 that they assume the position according to FIG. 1 and in conjunction with shoulder 24 directly hold bushing 22 on cover plate 20, insertion slopes 37 facilitating joining.

The thus-preassembled unit, constituted by cover plate 20 and bushing 22, is now gripped by a gripper (not shown) and joined to the hotplate. Its leads 19, which at this time still project vertically from the hotplate, are also gripped by a gripper, which brings about reciprocal orientation of the ends of the four leads and holds them in this oriented position. The orientation or alignment corresponds to the arrangement of the passage openings 28 which, supported by the insertion funnel 31, can be easily automatically joined. The cover plate is then fixed in a conventional manner, e.g. by a central bolt, which is screwed into a corresponding cast projection and the ends of the leads 19 are bent over into the position shown in the drawing, where they are relatively closely positioned above the cover plate 20. Thus, they do not constitute an impediment during transportation and prior to the fitting of the hotplates in a cooker if an insulating connecting piece is fitted to the leads, are automatically somewhat raised again from the cover plate. This movement is not impeded by the depressions 32, which contribute to a good parallel guidance of the connecting leads. In the embodiment leads 19 are sufficiently long that they extend up to or beyond the hotplate circumference. However, they can also be made so short that they only project slightly out of the passage openings 28 and are there welded to other feed lines instead of being bent round. These feed lines are then located alongside leads 19 on the unrecessed, lower surface 30, i.e. on ribs formed between recesses 32. This ensures a certain electrical safety clearance between the feed lines and the cover plate 20.

In the present embodiment the leads terminate within the hotplate rim. The bushing and the method for the manufacture thereof is also eminently suitable for longer leads, because the ends are in any case gripped and oriented by a gripper and following threading, opening and retraction of the gripper, the cover plate falls of its own accord into the correct position. However, it is necessary for this purpose, as described, to fit the bushing 22 firmly and directly to the cover plate. It can be seen that the connecting piece has much smaller dimensions than the prior art and has in particular a lower thermal mass, so that it is easily possible to reach the requisite temperature for preventing condensate formation. It is also advantageous that the space between the bushing and the underside 40 of the hotplate body is free and large enough to permit the unhindered laying of the rigid leads. Therefore there is no need to place it round parts of the bushing. As a result of the depression 26 in the cover plate, the bushing can even be displaced in the direction of the hotplate body, so as to externally create an arrangement not projecting downwards over edge 27. The bushing, which is made from a relatively expensive and difficult to process insulating material, steatite, has a simple design and can be manufactured in material-saving manner in a simple split mold. The thickness of the bushing is less than a third and preferably only a fifth of the total length.

We claim:

1. An electric hotplate, comprising:

a hotplate body with heating resistors embedded on an underside of the hotplate body, a cover plate covering the underside of the hotplate body, a bushing for passage of connecting leads through the cover plate, the bushing being made from thermally stable insulating material, the bushing being inserted in an opening of the cover plate and having a plate-like shape with several passage openings, the passage openings being open to either side of the cover plate and receiving the connecting leads, the bushing being directly fixed to the cover plate in the vicinity of the opening in the cover plate by clamping means which positively clamp the bushing to the cover plate, thereby fixing the bushing in all directions by engagement between the bushing and the cover plate, whereby the connecting leads can be inserted through the passage openings of the bushing after the bushing is fixed to the cover plate.

2. The hotplate according to claim 1, wherein the bushing is spaced by a considerable distance from the underside of the hotplate body.

3. The hotplate according to claim 2, wherein the distance by which the bushing is spaced from the underside is at least half a height of a space between the underside of the hotplate body and the cover plate.

4. The hotplate according to claim 2, wherein the bushing is spaced from the underside of the hotplate body by a distance of the order of magnitude of a thickness of the bushing.

5. The hotplate according to claim 1, wherein the hotplate body is made from cast iron.

6. The hotplate according to claim 1, wherein the bushing is shaped as a flat plate located in a common plane with the cover plate and whose thickness is less than one-third of its length.

7. The hotplate according to claim 6, wherein the bushing has a thickness approximately one-fifth of its length.

8. The hotplate according to claim 1, wherein the clamping means include retaining clips on the cover plate and the bushing further comprises retaining recesses, in which engage the retaining clips of the cover plate.

9. The hotplate according to claim 8, wherein the bushing is oval and elongated and the retaining clips engage in a outwardly open recess of the bushing.

10. The hotplate according to claim 9, wherein the retaining clips engage in an outwardly open recess of the bushing arranged on two narrow sides of the oval and elongated bushing.

11. The hotplate according to claim 1, wherein the bushing further comprises, on a side of the bushing remote from the hotplate body, a flange-like shoulder, which is located in a cover plate portion recessed in a direction of the hotplate body.

12. The hotplate according to claim 1, wherein the passage openings have funnel-shaped extensions on a side thereof facing the hotplate body.

13. The hotplate according to claim 1, wherein the bushing further comprises insertion slopes on its outer edges of a side of the bushing facing the hotplate body.

14. An electric hotplate, comprising:

a hotplate body with heating resistors embedded on an underside of the hotplate body, a cover plate covering the underside of the hotplate, a bushing for passage of connecting leads through the cover plate, the bushing being made from thermally stable insulating material and being inserted in an opening of the cover plate and having several passage openings which are open to either side of the cover plate and which receive the leads, the bushing being directly fixed to the cover plate in a vicinity of the opening of the cover plate, the passage openings being arranged in a row and the bushing having on a side remote from the hotplate body groove-like depressions, which are at right angles to a direction defined by the row and run from one side of the bushing to another.

* * * * *